US009481071B2

(12) United States Patent
Ichihara et al.

(10) Patent No.: US 9,481,071 B2
(45) Date of Patent: Nov. 1, 2016

(54) GRINDING METHOD

(71) Applicant: SUMITOMO HEAVY INDUSTRIES, LTD., Tokyo (JP)

(72) Inventors: Koichi Ichihara, Yokosuka (JP); Hironobu Ishida, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 528 days.

(21) Appl. No.: 14/101,517

(22) Filed: Dec. 10, 2013

(65) Prior Publication Data

US 2014/0179202 A1 Jun. 26, 2014

(30) Foreign Application Priority Data

Dec. 25, 2012 (JP) ..... 2012-280838

(51) Int. Cl.
*B24B 53/07* (2006.01)
*B24B 7/02* (2006.01)

(52) U.S. Cl.
CPC *B24B 53/07* (2013.01); *B24B 7/02* (2013.01)

(58) Field of Classification Search
CPC ..... B24B 33/081; B24B 7/18; B24B 7/02; B24B 1/00; B24B 53/07; B23Q 15/0075
USPC ..... 451/541, 547
See application file for complete search history.

(56) References Cited

U.S. PATENT DOCUMENTS 2,048,520 A * 7/1936 Schurr ..... B23F 5/02 451/219
2,115,210 A * 4/1938 Mulholland ..... B24D 13/02 451/514
3,073,690 A * 1/1963 Hollis ..... B24B 19/028 125/11.01
3,519,908 A * 7/1970 Plumley ..... B23Q 15/0075 318/162

FOREIGN PATENT DOCUMENTS

JP 2010-069564 A 4/2010
JP 2010069564 A * 4/2010
JP 2010149249 A * 7/2010

* cited by examiner

*Primary Examiner* — Monica Carter
*Assistant Examiner* — Marcel Dion
(74) *Attorney, Agent, or Firm* — Squire Patton Boggs (US) LLP

(57) ABSTRACT

A work surface is ground by moving a grinding wheel, on an outer periphery of which a helical dressed groove having no intersection is formed, in a first direction being tilted with respect to a forward direction. Then, the work surface is ground by moving the grinding wheel in a second direction which is tilted with respect to a backward direction. When the grinding wheel is virtually moved for grinding in the forward direction, an extending direction of a virtual grinding trace formed by the dressed groove transcribed and the first direction are tilted in mutually opposite directions with respect to the forward direction. An absolute value of a tilt angle of the first direction is smaller than that of the extending direction of the virtual grinding trace. Rotation directions from the forward direction to the first direction and from the backward direction to the second direction are opposite.

4 Claims, 7 Drawing Sheets

30
20
15
31
θt(<0)
x
y
z

15
θt(>0)
33
32
20
31
x
y
z 34
20
35
15
31
33
x
y
z $$|\theta t| = \tan^{-1}\left(\frac{Vx}{Vy}\right)$$

$$Ly = \frac{Vy}{Ng}$$

$$\theta d = \tan^{-1}\left(\frac{Pd}{Ly}\right)$$

$$\theta t = -\theta d$$

GRINDING METHOD

RELATED APPLICATION

Priority is claimed to Japanese Patent Application No. 2012-280838, filed Dec. 25, 2012, the entire content of which is incorporated herein by reference.

BACKGROUND

1. Technical Field

The present invention relates to a grinding method to perform grinding while rotating a grinding wheel subjected to a dressing process.

2. Description of Related Art

In order to form a cutting edge on an outer peripheral surface of a grinding wheel, dressing (setting) of the grinding wheel is performed. In a state where a diamond dresser cuts into a depth of several tens of μm from the outer peripheral surface (operating surface) of the grinding wheel, while rotating the grinding wheel, the dressing is performed by sending the dresser at a constant speed in a direction of a rotation axis. This dressing forms a helical groove on the outer peripheral surface of the grinding wheel.

While rotating the grinding wheel which has been dressed, grinding is performed by moving a workpiece back and forth in a circumferential speed direction of the grinding wheel. When the grinding is performed in a state where the outer peripheral surface of the grinding wheel is cut to a depth of several μm to ten-odd μm from a surface of the workpiece, a helical groove formed on the outer peripheral surface of the grinding wheel is transcribed and a straight line-shaped grinding trace is formed on the surface of the workpiece. The grinding trace includes a ridge portion and a valley portion which are alternately arranged.

The grinding trace formed when the workpiece is moved forward (during forward grinding) and the grinding trace formed when the workpiece is moved backward (during backward grinding) are tilted with respect to a moving direction of the workpiece in directions opposite to each other and intersect each other. The ridge portion formed during a forward movement is cut out at an intersection point with the valley portion formed during a backward movement. In addition, the ridge portion formed when moving backward is also cut out at the intersection point with the valley portion formed when moving forward. A region where the ridge portion is disconnected and a region where the ridge portion remains periodically appear in a grinding direction. If a surface plate painted in red lead is rubbed against the surface which has been ground, a region where a high ridge portion remains is colored and a region where the ridge portion is disconnected is not colored. Accordingly, a shading pattern is observed. This shading pattern periodically appears in the grinding direction, and is called a chatter pattern.

PTL 1 discloses a grinding method which can prevent occurrence of the chatter pattern. The grinding method employs the grinding wheel subjected to the dressing process in one direction. It is possible to suppress the occurrence of the chatter pattern by rotating the grinding wheel in opposite directions during the forward movement and the backward movement of the workpiece.

PRIOR ART DOCUMENT LIST

Patent Literature

[PTL 1] Japanese Unexamined Patent Application Publication No. 2010-69564

SUMMARY

According to an embodiment of the present invention, there is provided a grinding method including (a) a step of grinding a work surface by moving a grinding wheel in which a helical dressed groove having no intersection on an outer peripheral surface is formed, to a workpiece relatively in a first grinding direction which is tilted to a forward reference direction perpendicular to an axis of the grinding wheel, while rotating the grinding wheel, about the axis of the grinding wheel as a rotation center, in a state where the outer peripheral surface is brought into contact with the work surface of the workpiece; and (b) a step of grinding the work surface by moving the grinding wheel to the workpiece relatively in a second grinding direction which is tilted to a backward reference direction opposite to the forward reference direction, after the step (a). When the grinding wheel is virtually moved for grinding in the forward reference direction, an extending direction of a virtual grinding trace formed by the dressed groove transferred onto the workpiece and the first grinding direction are tilted in mutually opposite directions based on the forward reference direction, and thus an absolute value of a tilt angle in the first grinding direction is smaller than an absolute value of a tilt angle in the extending direction of the virtual grinding trace. A rotation direction of a tilt from the forward reference direction to the first grinding direction and a rotation direction of the tilt from the backward reference direction to the second grinding direction are opposite to each other.

DETAILED DESCRIPTION

If grinding can be performed without reversing a rotation direction of a grinding wheel, it is possible to increase throughput. There is a need for providing a grinding method which can suppress occurrence of a chatter pattern without reversing the rotation direction of the grinding wheel.

According to an embodiment described below, the grinding trace formed by transcription of the dressed groove can approach parallel to the forward reference direction. This can suppress occurrence of a chatter pattern.

Figure 1:
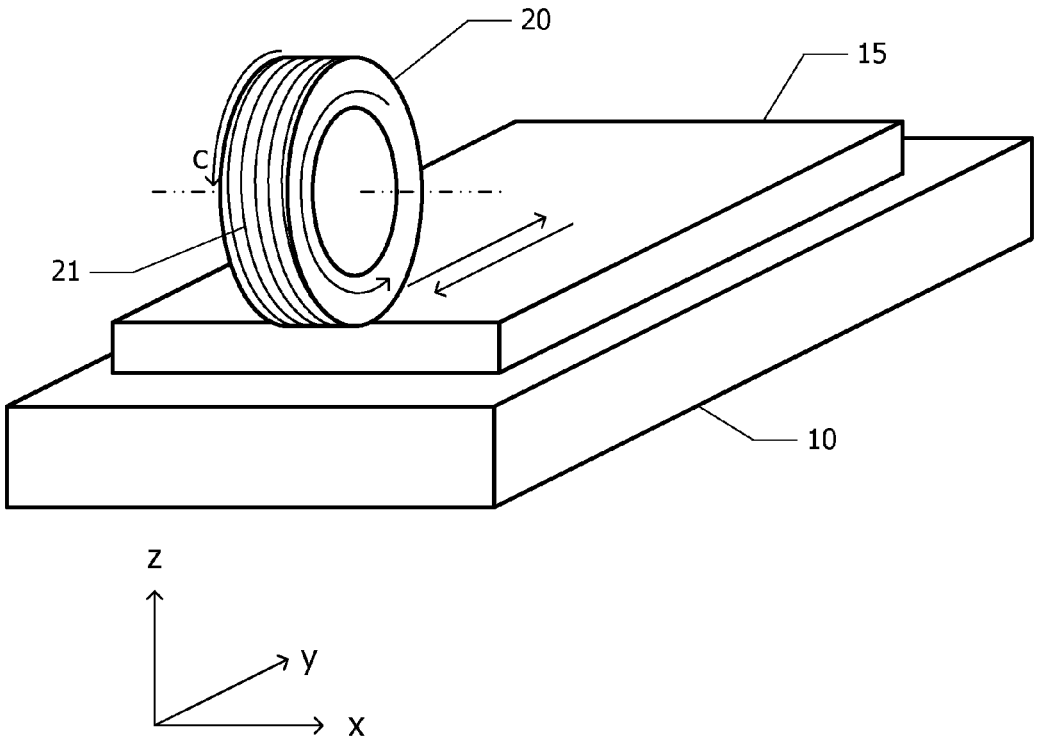
FIG. 1 is a schematic perspective view of a grinding apparatus used in a grinding method according to an embodiment.

FIG. 1 illustrates a schematic perspective view of a grinding apparatus used in a grinding method according to an embodiment. A workpiece 15 is held on a table 10. A grinding wheel 20 is supported above the table 10. The grinding wheel 20 is rotated around an axis thereof as a rotation center. A helical dressed groove 21 is formed by performing a dressing process on an outer peripheral surface (operating surface) of the grinding wheel 20. An xyz orthogonal coordinate system is defined in which a direction parallel to the axis of the grinding wheel 20 is defined as an x direction and a normal direction on an upper surface of the table 10 is defined as a z direction. A circumferential speed direction of the outer peripheral surface of the grinding wheel 20 is defined as a c direction.

Figure 2:
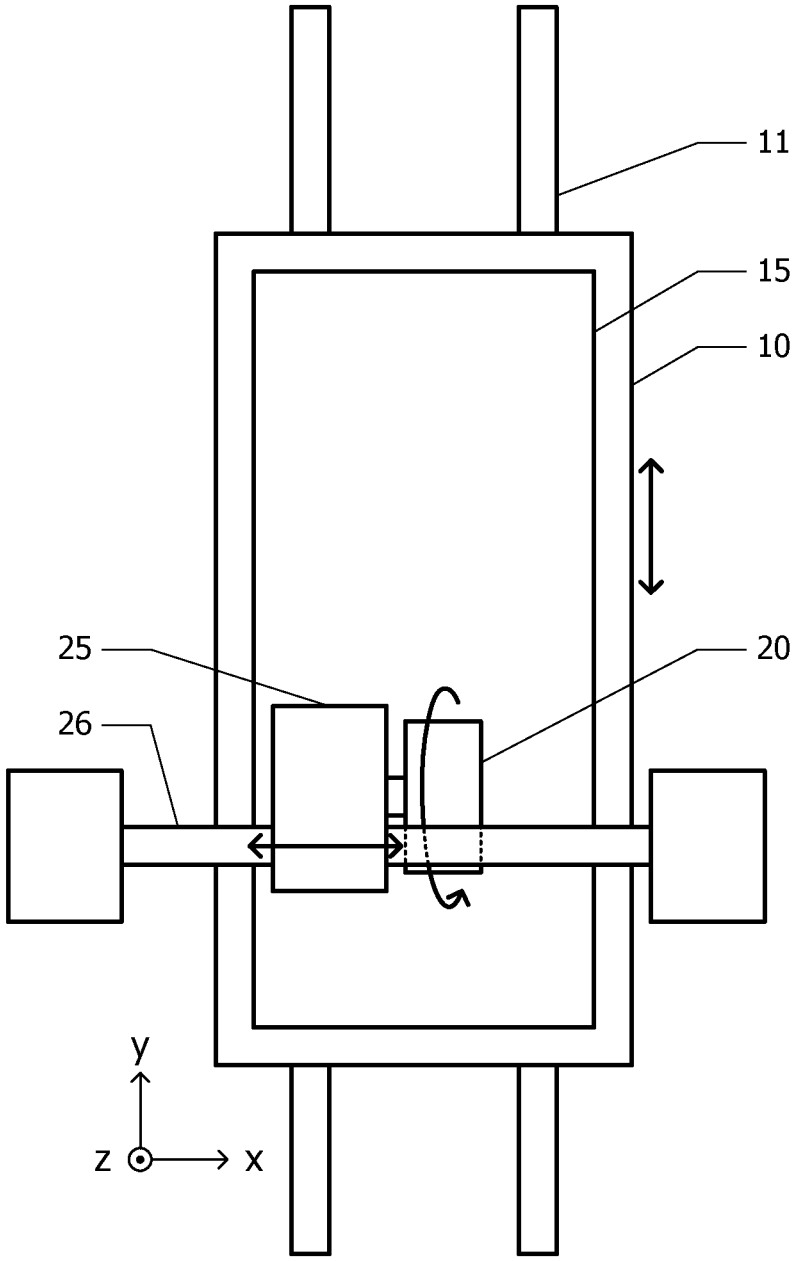
FIG. 2 is a plan view of a grinding apparatus.

FIG. 2 illustrates a plan view of the grinding apparatus. The workpiece 15 is held on the table 10. A table movement mechanism 11 moves the table 10 back and forth in a y direction. A rotation mechanism 25 rotates the grinding wheel 20 around the axis parallel to the x direction as a rotation center. A grinding wheel feeding mechanism 26 translates the grinding wheel 20 and the rotation mechanism 25 in the X direction.

Figure 3A:
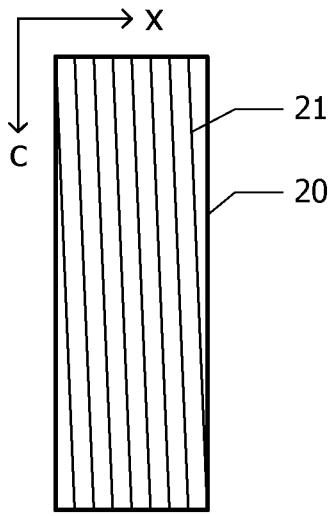
FIG. 3A is a development plan of an outer peripheral surface of a grinding wheel.
Figure 3B:
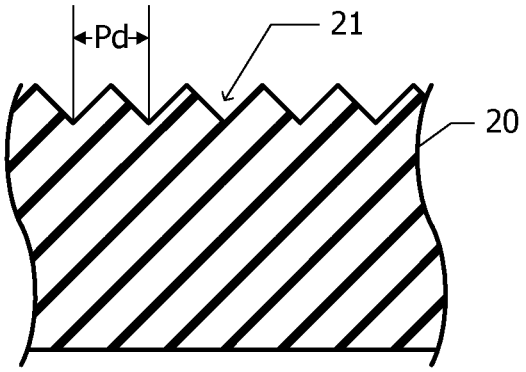
FIG. 3B is a cross-sectional view passing through an axis of a grinding wheel.

FIG. 3A illustrates a development plan of the outer peripheral surface of the grinding wheel 20. FIG. 3B illustrates a cross-sectional view passing through the axis of the grinding wheel 20. In FIG. 3A, a vertical direction corresponds to the circumferential speed direction c of the outer peripheral surface. A helical dressed groove 21 is formed by dressing the outer peripheral surface of the grinding wheel 20. The dressed groove 21 having a constant pitch Pd is formed by feeding a dresser at a constant speed in a direction parallel to the axis while the grinding wheel 20 is rotated at a constant rotational speed. The dressing of the grinding wheel 20 is performed by setting a feeding direction of the dresser to one direction. Therefore, the dressed groove 21 does not intersect, and, in the development plan, the dressed groove 21 is tilted with respect to the c direction and exhibits stripes arranged at equal intervals. The helical shape of the dressed groove 21 may be a shape of a thread groove of a single thread screw, or may be a shape of thread grooves of a multiple thread screw.

Before describing the embodiment, a grinding method will be described according to a comparative example which employs the grinding wheel 20 illustrated in FIGS. 3A and 3B. In the comparative example, the grinding is performed by moving the table 10 (refer to FIG. 2) back and forth in the y direction while the grinding wheel 20 is rotated.

Figure 4A:
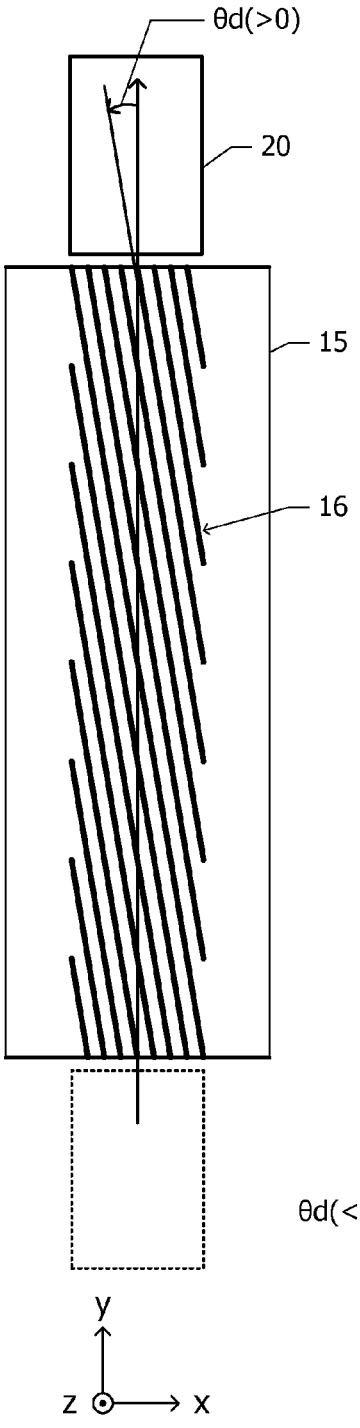
FIG. 4A is a schematic view of grinding traces formed by forward grinding in a grinding method according to a comparative example.

FIG. 4A illustrates a schematic view of grinding traces formed by the forward grinding. In the forward grinding, the grinding is performed while the workpiece 15 is moved in a negative direction of the y axis. At this time, the grinding wheel 20 is moved with respect to the workpiece 15 relatively in a positive direction of the y axis (hereinafter, referred to as a "forward reference direction"). As an example, a circumferential speed of the grinding wheel 20 is 30 m/sec, and a movement speed of the workpiece 15 is 30 m/min. The grinding traces 16 are formed in such a manner that the dressed groove 21 of the outer peripheral surface of the grinding wheel 20 is transcribed to a surface of the workpiece 15. The grinding traces 16 consist of multiple linear patterns which are parallel to one another, and each of the linear patterns is tilted counterclockwise with respect to the forward reference direction. In the description, an angle tilted counterclockwise from a direction serving as a reference is defined as "positive". An angle at which the grinding traces are tilted from the forward reference direction is represented by θd. In the example illustrated in FIG. 4A, the angle θd is positive. The angle θd is formed in such a manner that a lead angle of the dressed groove appearing on the outer peripheral surface (operating surface) of the grinding wheel is transcribed to a work surface. Hereinafter, the angle θd is referred to as a "dressing lead transcription angle". FIG. 4A illustrates ridge portions of the grinding traces 16 by using a solid line.

Figure 4B:
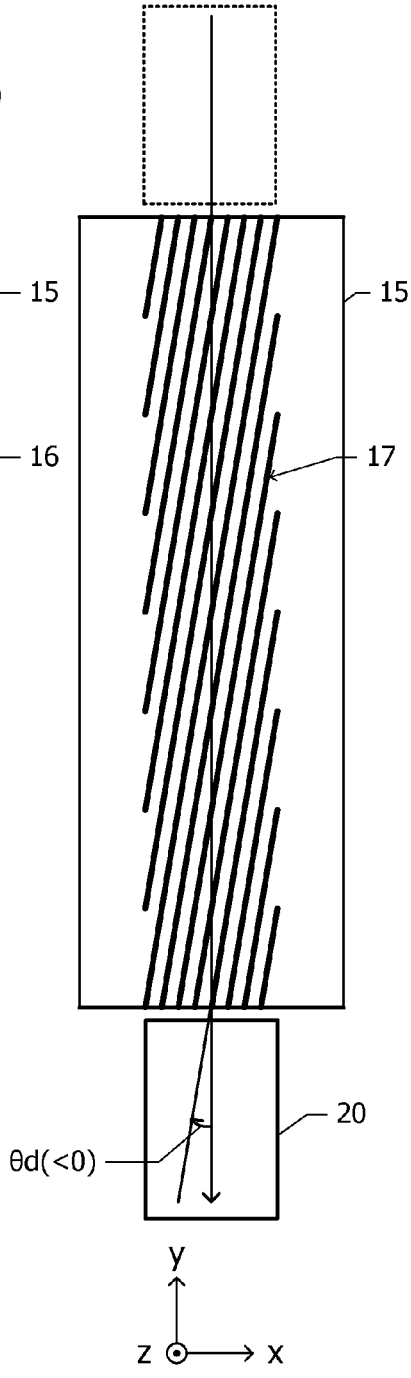
FIG. 4B is a schematic view of grinding traces formed by backward grinding.

FIG. 4B illustrates a schematic view of the grinding traces formed by the backward grinding. The rotation directions of the grinding wheel 20 are the same as each other in the forward grinding and the backward grinding. In the backward grinding, the grinding wheel 20 is moved with respect to the workpiece 15 relatively in a negative direction of the y axis (hereinafter, referred to as a "backward reference direction"). Even in the backward grinding, grinding traces 17 are formed in such a manner that the dressed groove 21 (refer to FIG. 3A) of the outer peripheral surface of the grinding wheel 20 is transcribed to the surface of the workpiece 15. Similar to the grinding traces 16, the grinding traces 17 also consist of multiple linear patterns in parallel to one another.

The rotation direction of the grinding wheel 20 is the same as the rotation direction during the forward grinding, and the movement direction of the grinding wheel 20 is opposite to the movement direction during the forward grinding. Accordingly, the grinding traces 17 are tilted clockwise from the backward reference direction. An absolute value of a tilt angle is equal to an absolute value of the dressing lead transcription angle θd illustrated in FIG. 4A, and the sign of the tilt angle is opposite to the sign of the angle θd. Therefore, the grinding traces 16 formed during the forward grinding and the grinding traces 17 formed during the backward grinding intersect each other. FIG. 4B illustrates the ridge portions of the grinding traces 17 by using a solid line.

Figure 4C:
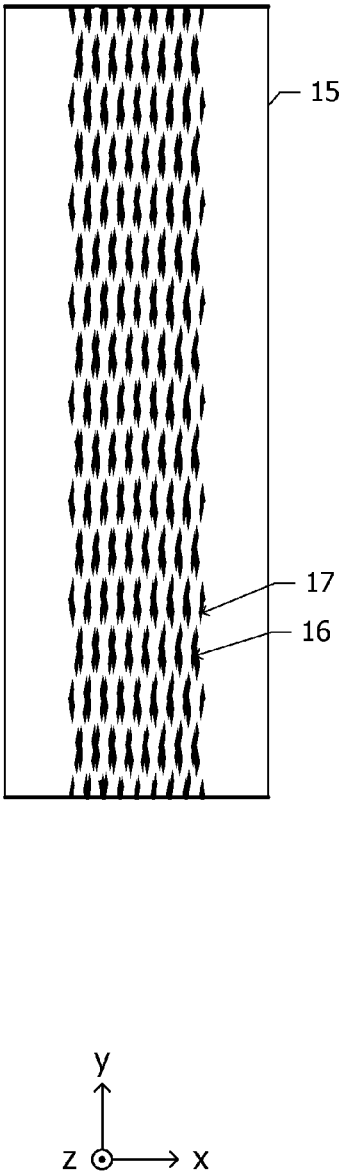
FIG. 4C is a schematic view illustrating overlapped grinding traces formed by forward grinding and backward grinding.

FIG. 4C illustrates a schematic view of the overlapped grinding traces formed by forward grinding and backward grinding. The ridge portions of the grinding traces 16 which have been formed during the forward grinding of the grinding wheel 20 are partially scrapped away during the backward grinding of the grinding wheel 20. Accordingly, the ridge portions of the grinding traces 16 are disconnected. In addition, the ridge portions of the grinding traces 17 formed during the backward grinding are disconnected by groove portions of the grinding traces 16 which have been formed during the forward grinding. Regions where the ridge portions of the grinding traces 16 and 17 remain and regions where the ridge portions are disconnected alternately and periodically appear in the y direction. The periodical pattern is observed as a chatter pattern.

Next, referring to FIGS. 5A to 7B, a grinding method according to the embodiment will be described.

Figures 5A, 5B, 5C:
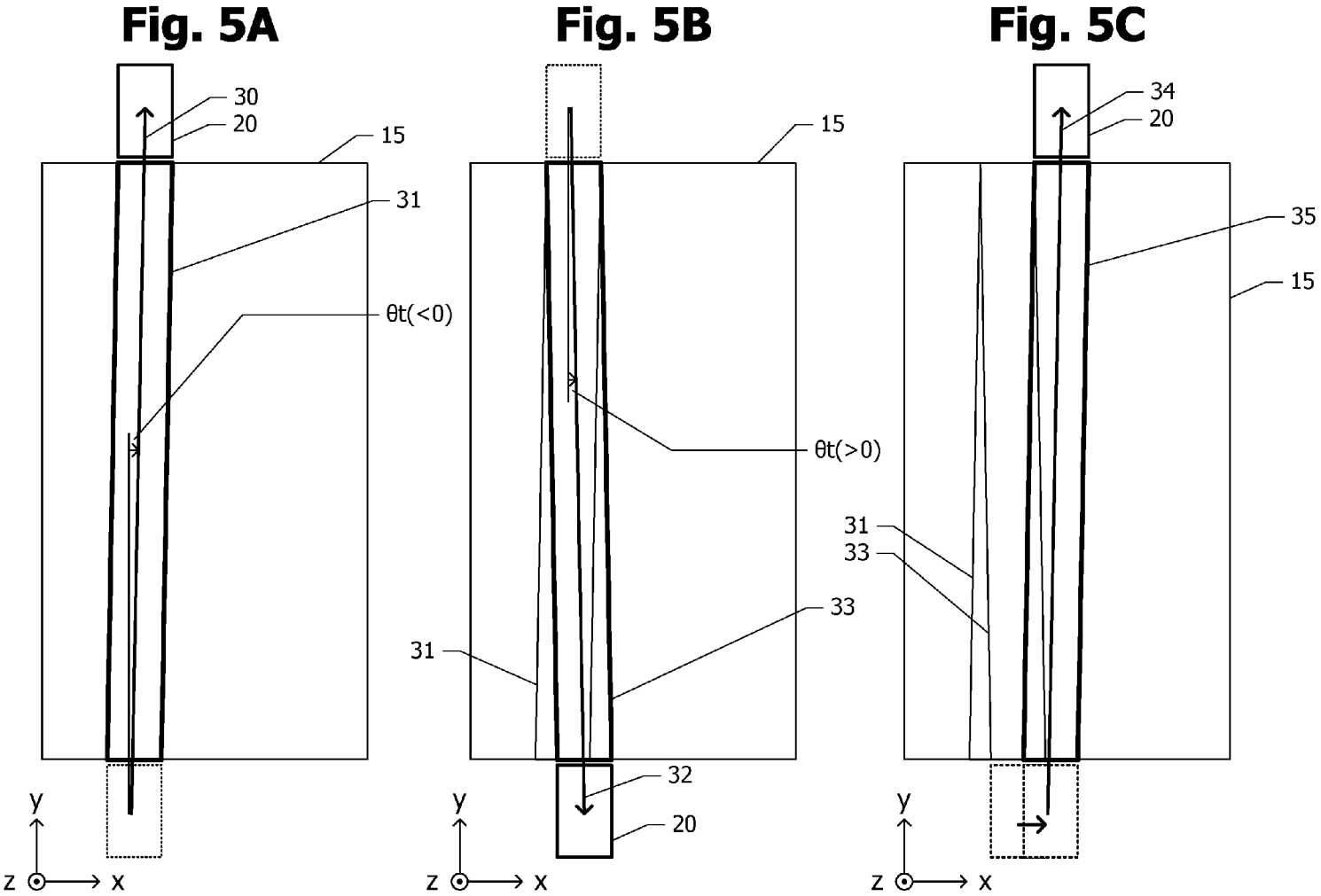
FIG. 5A is a plan view of a workpiece when forward grinding is completed in a grinding method according to the embodiment.
FIG. 5B is a plan view of the workpiece when backward grinding is completed.
FIG. 5C is a plan view of the workpiece when the subsequent forward grinding is completed.

As illustrated in FIG. 5A, the forward grinding is performed by relatively moving (moving forward) the grinding wheel 20 in a first grinding direction 30 with respect to the workpiece 15 while the grinding wheel 20 is rotated. The first grinding direction 30 is tilted clockwise from the forward reference direction (positive direction of the y axis). Therefore, a strip-shaped region 31 tilted with respect to the y direction is ground during the forward grinding of the grinding wheel 20.

With respect to the forward reference direction, the first grinding direction 30 is tilted in a direction opposite to a tilting direction of the grinding traces 16 illustrated in FIG. 4A. That is, when grinding is performed in the forward grinding direction, an extending direction of a virtual grinding traces 16 (refer to FIG. 4A) formed by transcription of the dressed groove 21 to the workpiece 15 and the first grinding direction 30 are tilted in mutually opposite directions from the forward reference direction. Hereinafter, a tilt angle θt of the first grinding direction 30 from the forward reference direction is referred to as a "grindstone feeding angle of the first grinding direction 30". In the embodiment, the absolute value of the dressing lead transcription angle θd (refer to FIG. 4A) illustrated in FIG. 4A is equal to the absolute value of the grindstone feeding angle θt of the first grinding direction 30, and signs of both are opposite to each other.

In order to move the grinding wheel 20 in the first grinding direction 30, the table 10 (refer to FIG. 2) may be moved in a direction opposite to the forward reference direction (negative direction of the y axis) and the grinding wheel 20 (refer to FIG. 2) may be moved in the x direction. It is possible to adjust the grindstone feeding angle θt of the first grinding direction 30 by adjusting a ratio of the movement speed of the table 10 to the movement speed of the grinding wheel 20.

Figure 6A:
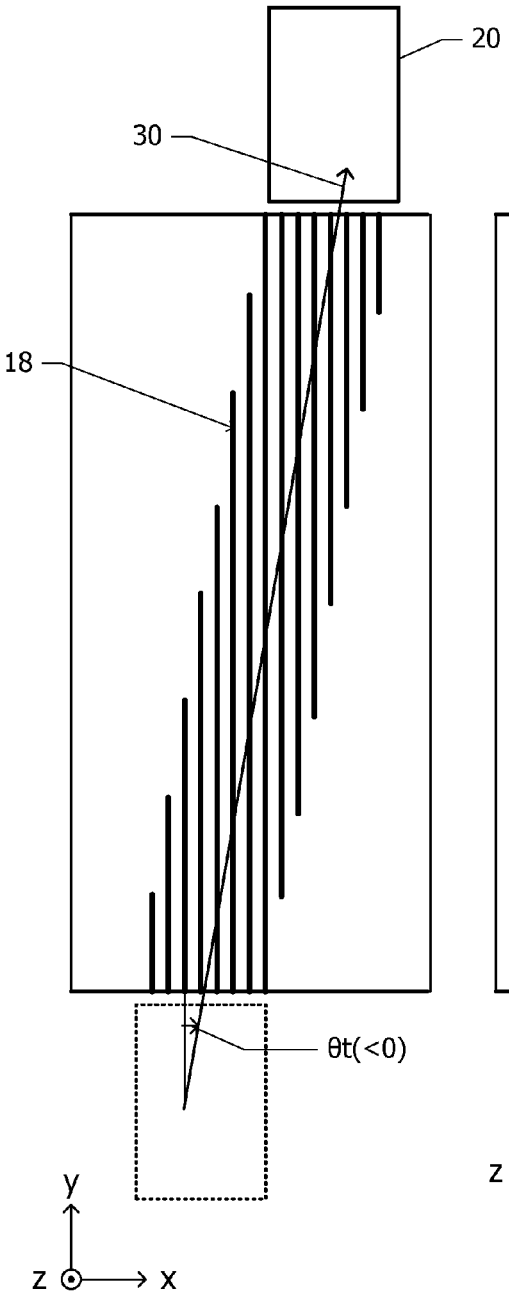
FIG. 6A is a schematic view of a surface of the workpiece when forward grinding is completed in the grinding method according to the embodiment.

FIG. 6A illustrates a schematic view of grinding traces 18 formed during the forward grinding of the grinding wheel 20. The absolute value of the dressing lead transcription angle θd illustrated in FIG. 4A is equal to the absolute value of the grindstone feeding angle θt of the first grinding direction 30, and signs of both are opposite to each other. Thus, the grinding traces 18 formed during the forward grinding of the grinding wheel 20 are parallel to the y direction.

As illustrated in FIG. 5B, after completing the forward grinding, the backward grinding is performed by relatively moving (moving backward) the grinding wheel 20 with respect to the workpiece 15 in a second grinding direction 32, while the grinding wheel 20 is rotated. The rotation direction of the grinding wheel 20 is the same as the rotation direction during the forward grinding. The second grinding direction 32 is tilted counterclockwise from the backward reference direction (negative direction of the y axis) opposite to the forward reference direction. A tilt angle of the second grinding direction 32 from the backward reference direction is referred to as a "grindstone feeding angle of the second grinding direction 32". Sign of the grindstone feeding angle of the second grinding direction 32 is opposite to sign of the grindstone feeding angle θt of the first grinding direction 30. In other words, in the forward grinding and the backward grinding, moving directions relating to the x direction of the grinding wheel 20 with respect to the workpiece 15 are the same. During the backward grinding of the grinding wheel 20, a strip-shaped region 33 tilted with respect to the y direction is ground.

The region 31 ground during the forward grinding of the grinding wheel 20 and the region 33 ground during the backward grinding of the grinding wheel 20 are partially overlapped with each other. As an example, in a positive side end portion of the y axis, the strip-shaped region 31 and the strip-shaped region 33 coincide with each other in relation to the x direction. In a negative side end portion of the y axis, the strip-shaped region 33 ground during the backward grinding is shifted in the x direction with respect to the strip-shaped region 31 ground during the forward grinding. The grindstone feeding angle θt of the first grinding direction 30 is, for example, approximately 1 mrad (1 milliradian) and is sufficiently small. Thus, the strip-shaped region 31 and the strip-shaped region 33 are partially overlapped with each other in the negative side end portion of the y axis.

The absolute value of the grindstone feeding angle of the second grinding direction 32 is the same as the absolute value of the grindstone feeding angle θt (refer to FIG. 5A) of the first grinding direction 30.

Figure 6B:
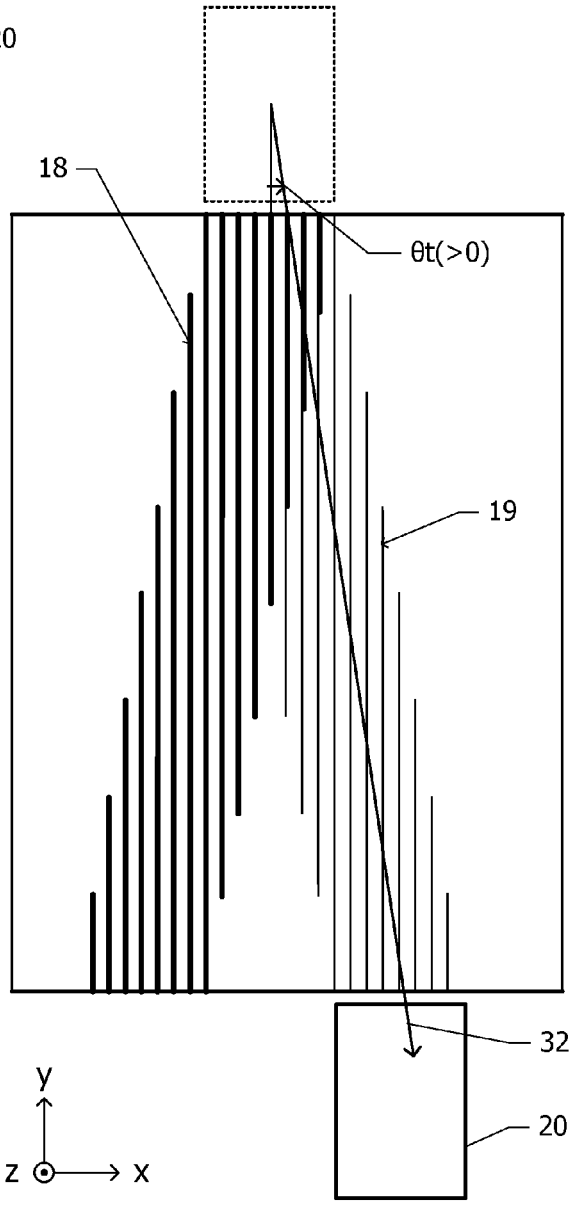
FIG. 6B is a schematic view of the surface of the workpiece when backward grinding is completed.

FIG. 6B illustrates a schematic view of the grinding traces 19 formed during the backward grinding of the grinding wheel 20 and the grinding traces 18 formed during the forward grinding. The absolute value of the grindstone feeding angle θt of the second grinding direction 32 is the same as the absolute value of the grindstone feeding angle θt (refer to FIG. 5A) of the first grinding direction 30, and signs of both are opposite to each other. Accordingly, the grinding traces 19 formed during the backward grinding of the grinding wheel 20 are also parallel to the y direction. Therefore, the grinding traces 18 formed during the forward grinding of the grinding wheel 20 and the grinding traces 19 formed during the backward grinding of the grinding wheel 20 do not intersect each other. Therefore, it is possible to prevent the occurrence of the chatter pattern.

As illustrated in FIG. 5C, if the backward grinding is completed, the grinding wheel 20 is moved with respect to the workpiece 15 in the x direction. Thereafter, the subsequent backward grinding is performed by relatively moving the grinding wheel 20 with respect to the workpiece 15 in a third grinding direction 34. A strip-shaped region 35 is ground by this grinding. The third grinding direction 34 is parallel to the first grinding direction 30. A distance through which the grinding wheel 20 is moved in the x direction between the backward grinding and the subsequent forward grinding is set so that a gap is not formed between the strip-shaped region 35 and the strip-shaped region 31. For example, the strip-shaped region 35 is partially overlapped with the strip-shaped region 31. After the forward grinding illustrated in FIG. 5C is performed, the backward grinding is performed.

In this manner, it is possible to grind the entire region to be ground within the surface of the workpiece 15 by alternately performing processes of the forward grinding and processes of the backward grinding.

Figure 7A:
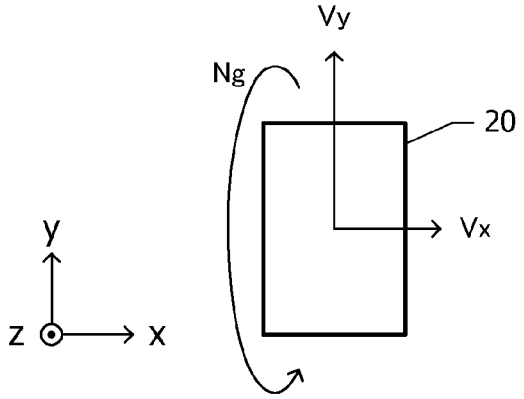
FIG. 7A is a view illustrating a movement speed and a rotation speed of a grinding wheel.
Figure 7B:
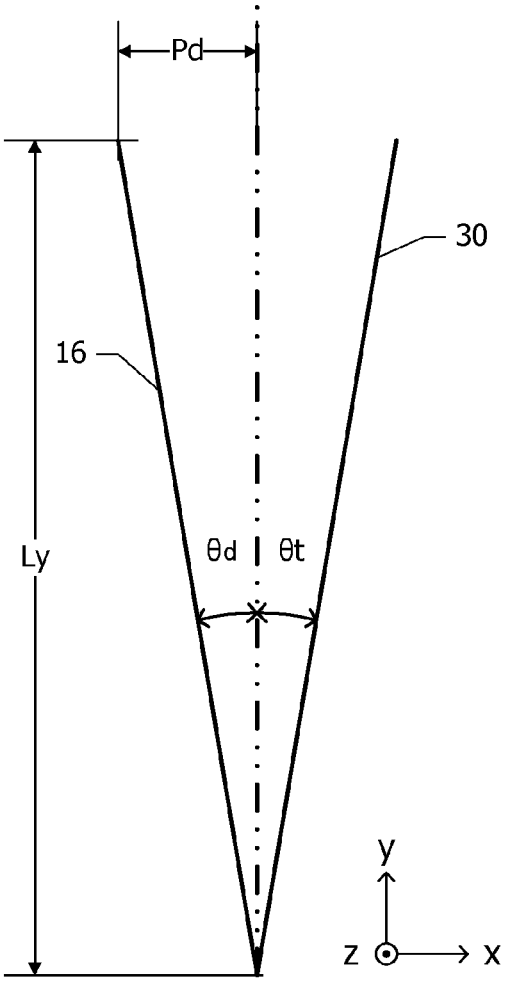
FIG. 7B is a view illustrating a relationship among reference direction (y direction), grinding traces, and a first grinding direction.

Referring to FIGS. 7A and 7B, sizes of the dressing lead transcription angle θd (refer to FIG. 4A) and the grindstone feeding angle θt of the first grinding direction 30 (refer to FIG. 6A) will be described.

As illustrated in FIG. 7A, a y component and an x component of the speed of the grinding wheel 20 during the forward grinding (refer to FIG. 5A) are represented by Vy and Vx, respectively. The rotation speed of the grinding wheel 20 is represented by Ng.

FIG. 7B illustrates a relationship among the forward reference direction (positive direction of the y axis), the grinding traces 16, and the first grinding direction 30. The absolute value of the grindstone feeding angle θt of the first grinding direction 30 is represented by $|\theta t|=\tan^{-1}(|Vx/Vy|)$.

While the grinding wheel 20 is rotated once, a distance Ly through which the workpiece 15 proceeds in the y direction is represented by $Ly=Vy/Ng$. While the grinding wheel 20 moves the distance Ly, the helical dressed groove 21 (refer to FIG. 1) corresponding to one rotation of the grinding wheel 20 is transcribed on the surface of the workpiece 15 as the grinding trace 16. A pitch in the x direction of the grinding traces 16 is equal to a pitch Pd (refer to FIG. 3B) of the dressed groove 21. Therefore, the absolute value of the dressing lead transcription angle θd is represented by $|\theta d|=\tan^{-1}(|Pd/Ly|)$.

The grinding is performed in such a condition that the absolute value of the grindstone feeding angle θt of the first grinding direction 30 is equal to the absolute value of the dressing lead transcription angle θd, and signs of both angles are opposite to each other. Accordingly, it is possible to prevent the occurrence of the chatter pattern.

The absolute value of the grindstone feeding angle θt of the first grinding direction 30 and the absolute value of the dressing lead transcription angle θd may not necessarily be equal to each other. If signs of the grindstone feeding angle θt and the dressing lead transcription angle θd are opposite to each other and the absolute value of the grindstone feeding angle θt is smaller than the absolute value of the dressing lead transcription angle θd, the tilt angle of the grinding traces (refer to FIG. 6A) with respect to the forward reference direction is smaller than the dressing lead transcription angle θd. Similarly, the absolute value of the tilt angle of the grinding traces 19 (refer to FIG. 6B) with respect to the backward reference direction is smaller than the absolute value of the dressing lead transcription angle θd illustrated in FIG. 4B. Therefore, the pitch in the y direction of the regions where the grinding traces 18 and the grinding traces 19 intersect is increased, thereby reducing adverse effects on outer appearance resulting from the chatter pattern.

In the grinding process, the work surface is ground until the workpiece has targeted dimensions in the finishing work. A process for grinding the entire region to be ground within the work surface by the constant cutting depth is referred to as a "unit grinding process". When the unit grinding process is performed multiple times, grinding traces formed during a certain unit grinding process are extinguished during the subsequent unit grinding process. Therefore, the grinding method according to the above-described embodiment may be applied to the final at least one unit grinding process, or preferably more than one unit grinding processes (grinding processes for finishing). In the other unit grinding process, similar to the methods in the related art, the grinding wheel 20 may be moved in the direction parallel to the y direction.

Hitherto, the present invention has been described according to the embodiment, but the present invention is not limited thereto. For example, it is apparent to those skilled in the art that various modifications, improvements and combinations can be made. Additionally, the modifications are included in the scope of the invention.

REFERENCE SIGNS LIST

10 table
11 table movement mechanism
15 workpiece
16, 17, 18, 19 grinding trace
20 grinding wheel
21 dressed groove
25 rotation mechanism
26 grinding wheel feeding mechanism
30 first grinding direction
31 strip-shaped region to be ground
32 second grinding direction
33 strip-shaped region to be ground
34 third grinding direction
35 strip-shaped region to be ground

What is claimed is:

1. A grinding method comprising:

(a) a step of grinding a work surface by relatively moving a grinding wheel, on an outer peripheral surface of which a helical dressed groove having no intersection is formed, with respect to a workpiece in a first grinding direction which is tilted with respect to a forward reference direction perpendicular to an axis of the grinding wheel, while rotating the grinding wheel around the axis of the grinding wheel as a rotation center, in a state where the outer peripheral surface is brought into contact with the work surface of the workpiece; and (b) a step of grinding the work surface by relatively moving the grinding wheel with respect to the workpiece in a second grinding direction which is tilted with respect to a backward reference direction opposite to the forward reference direction, after the step (a), wherein when the grinding wheel is virtually moved for grinding in the forward reference direction, an extending direction of a virtual grinding trace formed by the dressed groove transcribed on the workpiece and the first grinding direction are tilted in mutually opposite directions with respect to the forward reference direction, and thus an absolute value of a tilt angle of the first grinding direction is smaller than an absolute value of a tilt angle of the extending direction of the virtual grinding trace, and wherein a rotation direction of a tilt from the forward reference direction to the first grinding direction and a rotation direction of the tilt from the backward reference direction to the second grinding direction are opposite to each other.

2. The grinding method according to claim 1, wherein the first grinding direction and the second grinding direction are set so that a grinding trace formed by transcription of the dressed groove of the grinding wheel is parallel to the forward reference direction.

3. The grinding method according to claim 1, wherein in the step (a), the grinding wheel is relatively moved with respect to the workpiece in the first grinding direction by moving the workpiece in a direction opposite to the forward reference direction and by moving the grinding wheel in a direction orthogonal to the forward reference direction, and wherein in the step (b), the grinding wheel is relatively moved with respect to the workpiece in the second grinding direction by moving the workpiece in a direction opposite to the backward reference direction and by moving the grinding wheel in the same direction as a moving direction of the grinding wheel in the step (a).

4. The grinding method according to claim 1, further comprising, before the step (a):

(c) a step of grinding an entire region to be ground within the work surface by relatively moving the grinding wheel with respect to the workpiece in the forward reference direction or the backward direction, while rotating the grinding wheel around the axis of the grinding wheel as the rotation center, in a state where the outer peripheral surface is brought into contact with the work surface of the workpiece, wherein the entire region to be ground within the work surface is ground by alternately repeating the step (a) and the step (b), after the step (c).

* * * * *